US011264733B2

(12) United States Patent
Lahav et al.

(10) Patent No.: US 11,264,733 B2
(45) Date of Patent: Mar. 1, 2022

(54) WIDE-BEAM ANTENNA

(71) Applicant: QUALCOMM Incorporated, San Diego, CA (US)

(72) Inventors: Gadi Lahav, Ramat-Gan (IL); Elimelech Ganchrow, Zikhron Ya'akov (IL)

(73) Assignee: QUALCOMM Incorporated, San Diego, CA (US)

( * ) Notice: Subject to any disclaimer, the term of this patent is extended or adjusted under 35 U.S.C. 154(b) by 21 days.

(21) Appl. No.: 16/942,612

(22) Filed: Jul. 29, 2020

(65) Prior Publication Data

US 2022/0037802 A1 Feb. 3, 2022

(51) Int. Cl.
*H01Q 21/08* (2006.01)
*H01Q 9/16* (2006.01)

(52) U.S. Cl.
CPC ..... *H01Q 21/08* (2013.01); *H01Q 9/16* (2013.01)

(58) Field of Classification Search
CPC .... H01Q 21/06; H01Q 21/061; H01Q 21/062; H01Q 21/067; H01Q 21/08; H01Q 9/16; H01Q 9/18
See application file for complete search history.

(56) References Cited

U.S. PATENT DOCUMENTS 10,797,403 B2 * 10/2020 Adams ..... H01Q 19/108
2004/0104860 A1 * 6/2004 Durham ..... H01Q 9/285 343/785
2005/0030236 A1 * 2/2005 Durham ..... H01Q 1/523 343/753
2008/0174503 A1 * 7/2008 Kim ..... H01Q 9/30 343/722
2008/0246680 A1 * 10/2008 Rawnick ..... H01Q 9/285 343/795
2012/0146869 A1 * 6/2012 Holland ..... H01Q 21/061 343/795
2019/0280374 A1 * 9/2019 Kim ..... H01L 23/5389
2019/0305432 A1 * 10/2019 Kim ..... H01Q 9/0464
2020/0028277 A1 * 1/2020 Watson ..... H01Q 21/24
2020/0176877 A1 * 6/2020 Kim ..... H01Q 21/24
2020/0220268 A1 * 7/2020 Kim ..... H01Q 21/0006

* cited by examiner

*Primary Examiner* — Jason Crawford
(74) *Attorney, Agent, or Firm* — Hunter Clark PLLC

(57) ABSTRACT

Techniques are provided for constructing a wide-beam antenna, for example a dipole antenna printed over an arbitrary ground plane. An example antenna includes at least one wide-beam dipole antenna cell, comprising a substrate, one or more signal lines disposed in the substrate, a conductive cladding disposed on the substrate, a dielectric layer disposed on the conductive cladding, a first sidewall via through the dielectric layer and electrically coupled to the conductive cladding, a second sidewall via extending through the dielectric layer and electrically coupled to the conductive cladding, a dipole antenna element disposed on the dielectric layer between the first sidewall via and the second sidewall via, a first director element disposed on the dielectric layer and extending toward the dipole antenna element, and a second director element disposed on the dielectric layer and extending toward the dipole antenna element.

26 Claims, 10 Drawing Sheets

WIDE-BEAM ANTENNA

BACKGROUND

Wireless signals may be used for numerous applications. For example, with the proliferation of mobile communication devices, wireless signals of many frequencies and protocols have been, and/or are currently being, used for wireless communications, e.g., cellular communications, WiFi communications, etc. As another example, applications for distance detection have become popular, e.g., for sporting activities such as golf, and for driving assistance such as to help maintain a safe distance between moving vehicles or to warn of the approach of an object. As another example, applications for object detection have become more popular. Object detection may be useful for a variety of reasons/applications such as detecting the presence of a living object in a vicinity of a wireless charging system to help avoid harming the living object, collision avoidance for autonomous vehicle driving systems, etc.

To facilitate and/or enable wireless signal applications, numerous types of antennas have been developed, with different antennas used based on the needs of an application, e.g., distance, frequency, operational frequency bandwidth, antenna pattern beam width, gain, beam steering, etc. In particular, in phased array antenna systems, the beam width of both the scanning direction and the secondary direction should be taken into consideration.

SUMMARY

An example antenna system according to the disclosure includes at least one wide-beam dipole antenna cell, comprising a substrate with a top surface and a bottom surface, one or more signal lines disposed between the top surface and the bottom surface of the substrate, a conductive cladding disposed on the top surface of the substrate, a dielectric layer disposed on the conductive cladding, a first sidewall via extending orthogonal to the top surface of the substrate through the dielectric layer and electrically coupled to the conductive cladding, a second sidewall via extending orthogonal to the top surface of the substrate through the dielectric layer and electrically coupled to the conductive cladding, a dipole antenna element disposed on the dielectric layer between the first sidewall via and the second sidewall via, including a first dipole antenna element directed towards the first sidewall via and a second dipole antenna element directed towards the second sidewall via, at least one signal via configured to electrically couple the dipole antenna element to the one or more signal lines, a first director element disposed on the dielectric layer and extending toward the dipole antenna element, the first director element being electrically coupled to the first sidewall via, and a second director element disposed on the dielectric layer and extending toward the dipole antenna element, the second director element being electrically coupled to the second sidewall via.

Implementations of such an antenna system may include one or more of the following features. The at least one wide-beam dipole antenna cell may further include a first conductive area extending from the first sidewall via in a direction away from the dipole antenna element, and a second conductive area extending from the second sidewall via in a direction away from the dipole antenna element, the first conductive area and the second conductive area comprising a conductive cladding disposed on the dielectric layer. The first director element, the second director element and the dipole antenna element may be microstrip conductors. A distance between the first sidewall via and the second sidewall via may be approximately one and a quarter wavelengths of an operational frequency of the antenna system. A length of the first dipole antenna element or the second dipole antenna element may be approximately a quarter wavelength of an operational frequency of the antenna system. The first director element and the second director element may each extend in towards the dipole antenna element from the first sidewall via and the second sidewall via, respectively, for a distance of approximately one-eighth of a wavelength of an operational frequency of the antenna system. A distance between the dipole antenna element and the conductive cladding disposed on the top surface of the substrate may be approximately a quarter wavelength of an operational frequency of the antenna system with respect to a dielectric constant of the dielectric layer disposed between the dipole antenna element and the conductive cladding. A length of the dipole antenna element is approximately 1.55 mm, a distance between the first sidewall via and the second sidewall via is approximately 4.55 mm, and a length the first director element and the second director element extending in from the first sidewall via and the second sidewall via, respectively, is 0.45 mm. A dielectric constant of the dielectric layer may be approximately 3.3 to 4.0. A plurality of wide-beam dipole antenna cells may be disposed in a column wherein a corresponding plurality of first sidewall vias, dipole antenna elements, and second sidewall vias form approximately parallel columns A first area may extend outward from a first boundary line formed by a column of the first sidewall vias in a direction away from a column of the dipole antenna elements, and a second area may extend outward from a second boundary line formed by a column of the second sidewall vias in a direction away from the column of the dipole antenna elements, such that the first area and the second area include a conductive cladding disposed on the dielectric layer. A distance between the dipole antenna elements in each of the plurality of wide-beam dipole antenna cells may be approximately half a wavelength of an operational frequency of the antenna system. 30 to 70 wide-beam dipole antenna cells may be disposed in a column.

An example antenna system according to the disclosure includes a substrate with a cavity formed therein, the cavity having a first sidewall and a second sidewall disposed parallel to one another and forming the respective outside edges of the cavity, a dielectric material disposed in the cavity between the first sidewall and the second sidewall, a plurality of dipole antennas disposed on the dielectric material and at equal distances from one another along a centerline of the cavity, wherein each of the plurality of dipole antennas includes a first element directed towards the first sidewall and a second element directed towards the second sidewall, a plurality of first director elements disposed on the dielectric material along the first sidewall, wherein a distance between each of the plurality of first director elements is equal to the distance between each of the plurality of dipole antennas, and at least a portion of each of the plurality of first director elements extends inward towards one of the plurality of dipole antennas, and a plurality of second director elements disposed on the dielectric material along the second sidewall, wherein a distance between each of the plurality of second director elements is equal to the distance between each of the plurality of dipole antennas, and at least a portion of each of the plurality of second director elements extends inward towards one of the plurality of dipole antennas.

Implementations of such an antenna system may include one or more of the following features. A conductive layer may be disposed on the substrate in a first area extending outward from the first sidewall and away from the cavity, and a second area extending outward from the second sidewall and away from the cavity. A plurality of signal lines may be disposed under the cavity, such that at least one of the plurality of signal lines is operably coupled to at least one of the plurality of dipole antennas. The plurality of dipole antennas, the plurality of first director elements, and the plurality of second director elements may be microstrip conductors. A width of the cavity measured from the first sidewall to the second sidewall may be approximately 1.25 times a wavelength of an operational frequency of the antenna system. A length of each of the plurality of dipole antennas may be approximately 0.5 times a wavelength of an operational frequency of the antenna system. Each of the plurality of first director elements and each of the plurality of second director elements may extend in from the first sidewall and the second sidewall, respectively, for a distance of approximately 0.125 times a wavelength of an operational frequency of the antenna system. A distance between a distal end of each of the first elements in the plurality of dipole antennas and the first sidewall and a distal end of each of the second elements in the plurality of dipole antennas and the second sidewall may be approximately 0.5 times a wavelength of an operational frequency of the antenna system. A depth of the cavity and a thickness of the dielectric material may be approximately 0.25 times a wavelength of an operational frequency of the antenna system. A dielectric constant of the dielectric material may be approximately 3.3 to 4.0. The plurality of dipole antennas may include 30-70 dipole antennas. A distance between each of the plurality of dipole antennas may equal approximately 0.5 times a wavelength of an operational frequency of the antenna system. A length of each of the plurality of dipole antennas may be approximately 1.55 mm, a distance between the first sidewall via and the second sidewall via may be approximately 4.55 mm, and a length of each of the plurality of first director elements and each of the plurality of second director elements extending in from the first sidewall and the second sidewall, respectively, may be 0.45 mm.

Items and/or techniques described herein may provide one or more of the following capabilities, as well as other capabilities not mentioned. A cavity may be formed in a substrate such that the cavity is bounded by two conducting sidewalls. The boundary of the substrate may extend an arbitrary distance away from the cavity sidewalls. A dielectric material may be disposed in the cavity. A plurality of dipole antennas may be formed in a column along the center of the cavity and on top of the dielectric material. Director elements may extend in from the sidewalls for each of the plurality of dipole antennas. A conductive cladding may be disposed on the substrate in the areas extending away from the cavity. The widths of these areas may be arbitrary. The beam-width of the dipole antennas may be increased. The configuration of dipole antennas and directors may reduce the impact of the ground plane on the beam-width. A control system may be operably coupled to the plurality of dipole antennas to control the processing of signals transmitted or received by the dipole antennas. Phased array beamforming may be realized with the plurality of dipole antennas. Other capabilities may be provided and not every implementation according to the disclosure must provide any, let alone all, of the capabilities discussed.

DETAILED DESCRIPTION

Techniques are discussed herein for providing a wide-beam antenna, for example a dipole antenna printed over an arbitrary ground plane. In a phased array, the beam width of both the scanning direction and the secondary direction need to be taken into consideration. A scanning array with wide beams in both directions may be realized with a dipole antenna array in some implementations; however, the dimensions of the ground plane can affect the beam width of a dipole antenna by narrowing it or adding unwanted side-lobes. In many manufacturing processes, the ground size is determined based on mechanical and electrical requirements rather than the desired radiation pattern. The arbitrary ground plane resulting from the manufacturing process may impact the antenna performance. The impact is significant in mmWave designs, such as 5G, 60 GHz and newer automotive radar systems, where current printed circuit board (PCB)/system in package (SiP) manufacturing processes have limited capabilities to manufacture the required antenna sizes which may be a few millimeters in length and/or mechanical requirements of a device implementation may dictate the size of an array. Certain of the designs provided herein reduce the impact of the ground plane and enable maintenance of a wide beam width in desired directions when an array is disposed on an arbitrary ground plane.

In an example, a wide-beam dipole antenna array includes multiple wide-beam dipole antenna cells. Each cell may include a dipole antenna comprising two microstrip lines extending in opposite directions. The dipole antenna may be disposed in a cavity such that the microstrip lines are directed towards the walls of the cavity. The distance between the microstrip lines and the respective cavity walls is approximately half of the desired wavelength (e.g., the free space wavelength at the desired operational frequency). Microstrip line director elements are disposed in the cell along each of the cavity walls and aligned with the dipole microstrip lines. The length of the director elements may be in the range of an eighth to a quarter of the wavelength. A combination of the cells may be used to form a beam and steer the beam (e.g., beam-forming) in a direction of the spacing of the cells (e.g., transverse to the microstrip lines). Other configurations, however, may be used.

Antennas discussed herein may be used for a variety of purposes. For example, antennas discussed herein may be used for wireless communication, e.g., millimeter-wave, broadband, high-speed wireless communication. As further examples, antennas discussed herein may be used for object detection (e.g., in automotive systems), distance determination, etc.

Figure 1:
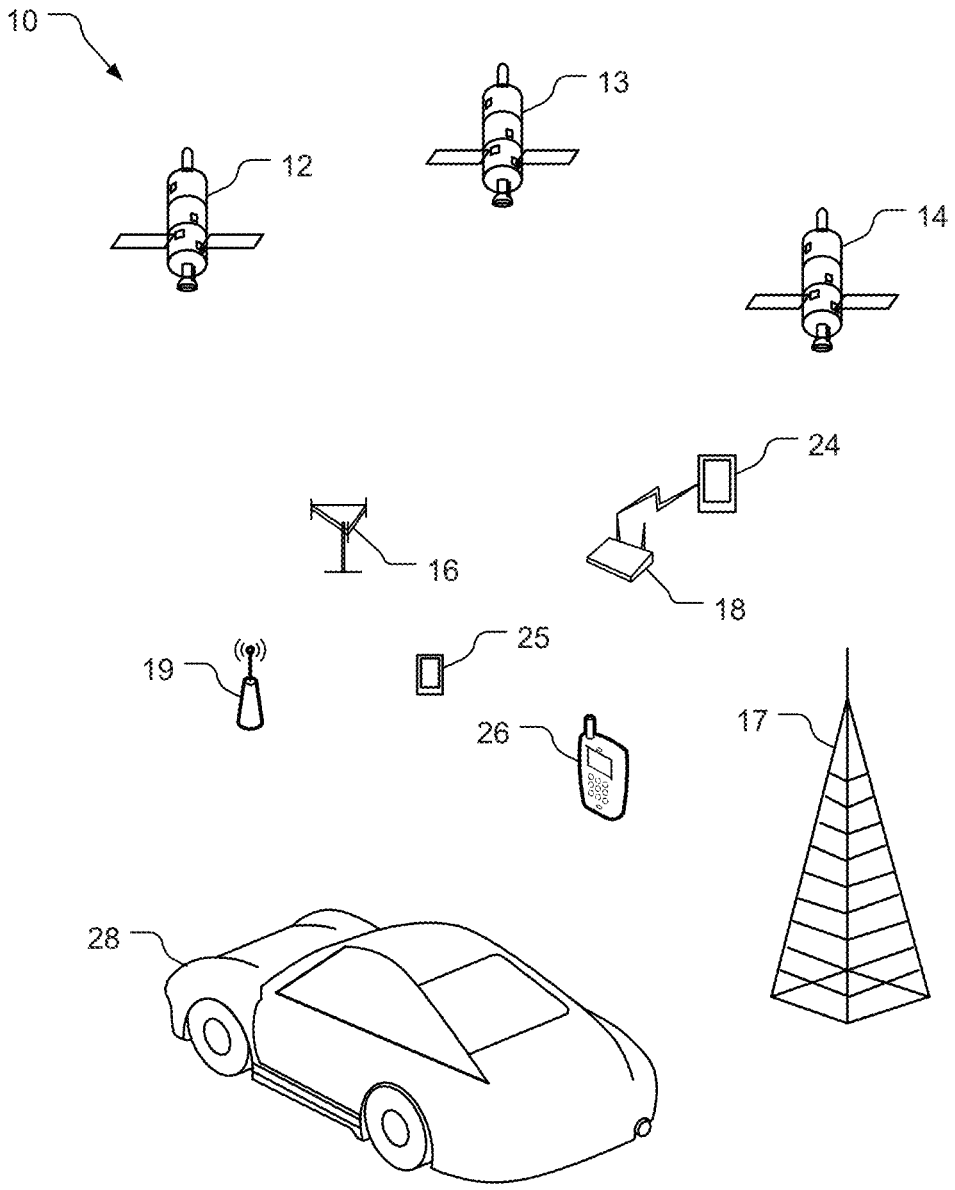
FIG. 1 is a simplified view of an environment that includes devices that may transmit and/or receive wireless signals.

Referring to FIG. 1, an environment 10 includes devices that may transmit and/or receive wireless signals for various purposes. The devices shown in FIG. 1 are not exhaustive, and many other devices may use wireless signals and techniques discussed herein may be applicable not only to one or more devices shown in FIG. 1, but to one or more of such other devices. The environment 10 includes satellites 12, 13, 14, base stations 16, 17, 18, 19, mobile devices 24, 25, 26, and a vehicle 28. Wireless signals with various properties may be used in the environment 10. For example, signals of different frequencies, protocols, signal strengths, encryption mechanisms, etc. may be used in the environment 10.

The base stations 16-19 may each be configured to use (e.g., transmit and/or receive) one or more types of wireless signals in accordance with one or more radio access technologies (RATs). For example, the base stations 16-19 may be configured to use wireless signals of one or more RATs including GSM (Global System for Mobile Communications), code division multiple access (CDMA), wideband CDMA (WCDMA), Time Division CDMA (TD-CDMA), Time Division Synchronous CDMA (TDS-CDMA), CDMA2000, High Rate Packet Data (HRPD), LTE (Long Term Evolution), 5G NR (5G New Radio), WiFi, and/or Bluetooth, etc. Each of the base stations 16, 17 may be a wireless base transceiver station (BTS), a Node B, an evolved NodeB (eNB), a 5G NodeB (SGNB), etc., and each of the base stations 18, 19 may be referred to as an access point and may be a femtocell, a Home Base Station, a small cell base station, a Home Node B (HNB), a Home eNodeB (HeNB), etc.

The mobile devices 24-26 may be configured in a variety of ways to use one or more of a variety of wireless signals. For example, each of the mobile devices 24-26 may be configured to use one or more of the RATs discussed above with respect to the base stations 16-19. The mobile devices 24-26 may be any of a variety of types of devices such as a smartphone, a tablet computer, a notebook computer, a laptop computer, etc. Each of the mobile devices 24-26 may be a User Equipment (UE), a 5G User Equipment (5G UE), a mobile station (MS), a subscriber unit, a target, a station, a device, a wireless device, a terminal, etc. The vehicle 28 may utilize wireless signals to communicate with one or more of the devices 12-26, and/or in one or more automotive radar systems. For example, the vehicle 28 may utilize transmit and receive antenna arrays for object detection and collision avoidance.

Figure 2:
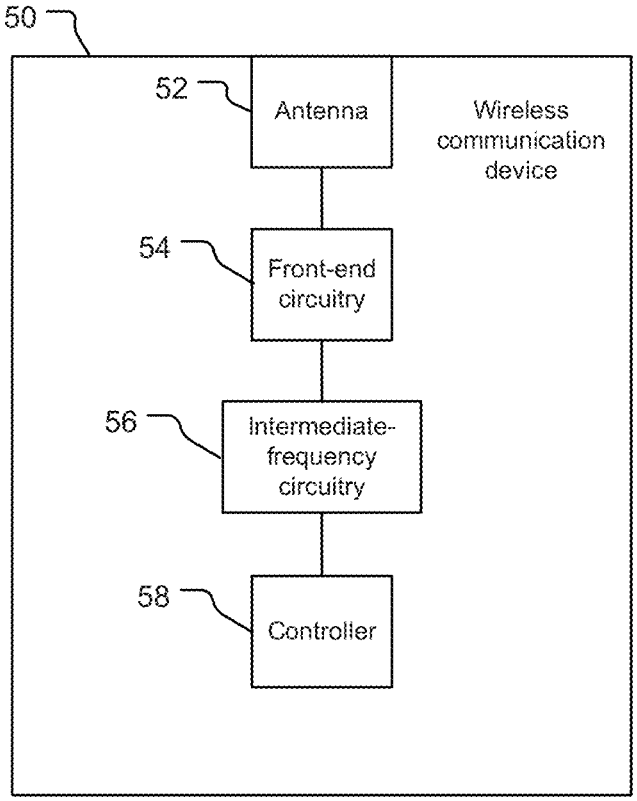
FIG. 2 is a simplified block diagram of an antenna system included in a device shown in FIG. 1.

Referring also to FIG. 2, each of the devices in the environment 10 may include one or more antenna systems 50 for transmitting and/or receiving wireless signals. The antenna system 50 includes an antenna 52, front-end circuitry 54, intermediate-frequency (IF) circuitry 56, and a controller 58. Different antenna systems may share one or more components (e.g., the controller 58 and/or at least a portion of the front-end circuitry 54 and/or at least a portion of the intermediate-frequency circuitry 56). Although the antenna system 50 is shown with only the antenna 52, the antenna system 50 may include more than one of the antenna 52, and each antenna may be electrically coupled to respective front-end circuitry or an array of antennas 52 may share front-end circuitry. There may be many different types of antennas collectively used by the devices in the environment 10. The discussion below discusses particular types of antennas that may be used by one or more of the devices in the environment 10, or by other devices in the environment 10 and/or in another environment.

The front-end circuitry 54 may be configured to provide signals to be radiated by the antenna 52 and/or may be configured to receive and process signals that are received by, and provided to, the front-end circuitry from the antenna 52. Alternatively, the front-end circuitry 54 may be configured only to send signals to, or only to receive signals from, the antenna 52. In such instances, different antennas may be used for transmit and receive. For example, antennas discussed below (e.g., dipole antennas) may be used for signal receipt (e.g., receipt of reflections of signals transmitted from other antennas) in some implementations. The front-end circuitry 54 may be configured to convert RF signals received by the antenna 52 to IF signals (e.g., using a low-noise amplifier and a mixer) and to send the IF signals to the IF circuitry 56. The IF circuitry 56 may be configured to convert IF signals received from the front-end circuitry 54 to baseband signals and to provide the baseband signals to the controller (processor) 58. The IF circuitry 56 may be configured to convert baseband signals provided by the controller 58 to IF signals, and to provide the IF signals to the front-end circuitry 54. In some embodiments, RF signals are directly down converted to baseband and/or baseband signals are directly converted to RF without the use of an intermediate frequency.

The controller 58 is communicatively coupled to the IF circuitry 56, which is communicatively coupled to the front-end circuitry 54, which is communicatively coupled to the antenna 52. In some embodiments, signals may be received from the antenna 52 by bypassing the front-end circuitry 54. In other embodiments, a transceiver that is integrated into or separate from the IF circuitry 56 may be configured to provide transmission signals to and/or receive signals from the antenna 52 without such signals passing through the front-end circuitry 54. In some embodiments, the front-end circuitry 54 may be configured to amplify, filter, and/or route signals from the antenna 52 without down conversion to the IF circuitry 56.

The controller 58 may be configured to steer an antenna beam of the antenna 52. The controller 58 may include one or more processors and appropriate instructions (e.g., stored on a non-transitory, processor-readable memory) that are configured to cause the processor(s) to perform one or more functions. The one or more functions may include controlling digital or analog beamforming processes. That is, the controller 58 may be configured to compute antenna patterns and the resulting range, azimuth, elevation and doppler information. For example, the controller 58 may configure phase shifters to cause signals to be received to the antenna 52 such that different radiators of the antenna 52 may receive signals at different phases, and with phase differentials that vary over time, to steer a receive beam of the antenna 52. That is, the controller 58 may be configured to receive signals at different times in the different elements (e.g., cells)

of the antenna 52, to steer a receive beam in response to the signals provided by the front-end circuitry 54.

Figure 3:
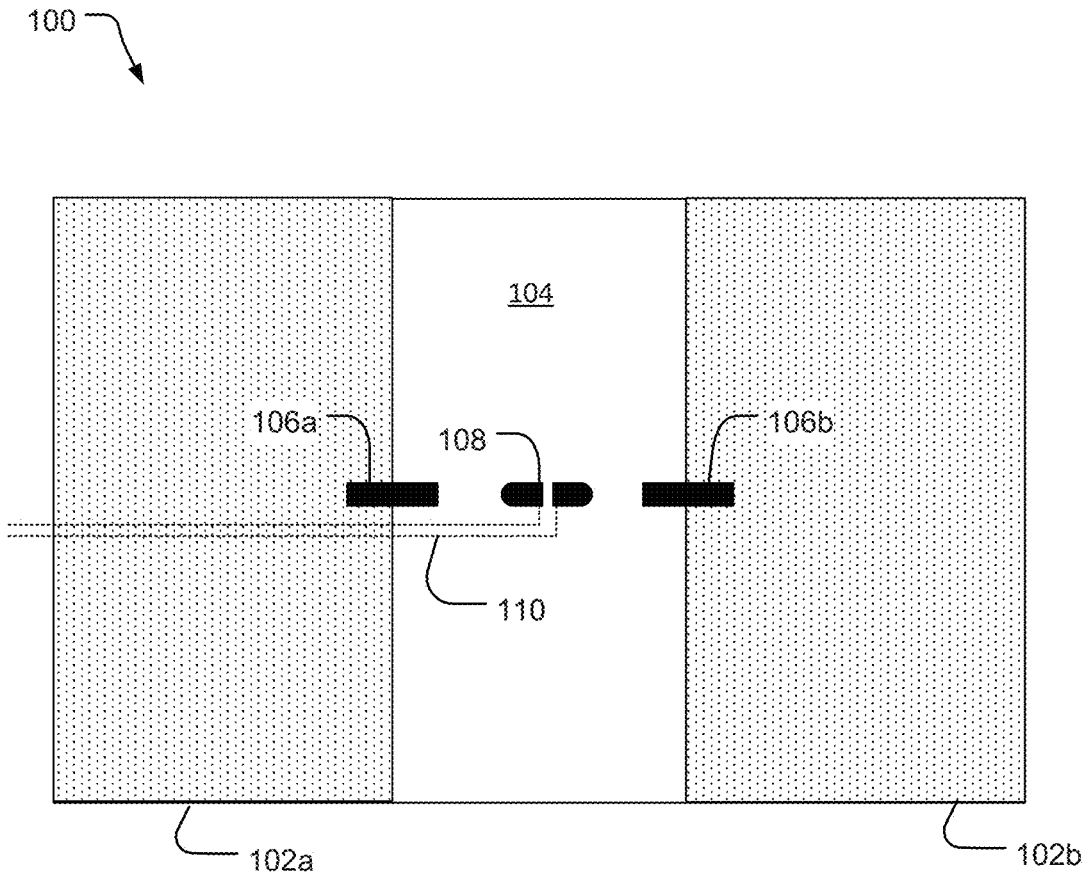
FIG. 3 is a top view of an example wide-beam dipole antenna.
Figure 4:
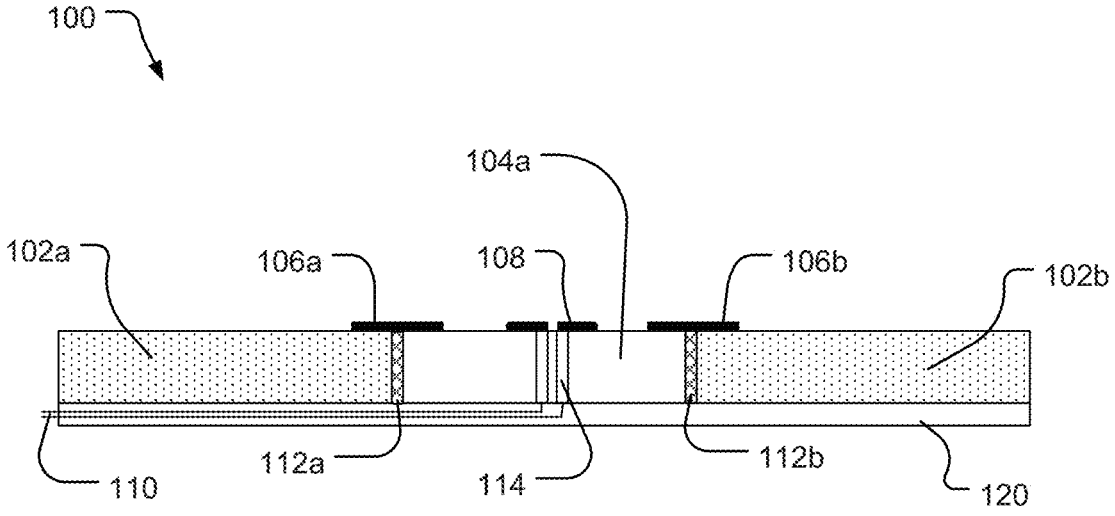
FIG. 4 is a side view of the example wide-beam dipole antenna shown in FIG. 3.

Referring to FIGS. 3-4, an antenna 100, that is an example of the antenna 52, includes a first area 102*a*, a second area 102*b*, a cavity area 104, a dipole antenna element 108, a first director element 106*a* and a second director element 106*b*. The antenna 100 may be constructed on a circuit board 120 (e.g., PCB material) including signal (feed) lines 110. The circuit board 120 may be a copper clad laminate substrate to provide a ground plane at the bottom of the cavity area 104. The dipole antenna element 108 may be coupled to the signal lines 110 with signal conductors 114 without contacting the copper cladding on the circuit board 120 (e.g., using non-plated through holes). The signal conductors 114 may be via (i.e., vertical interconnect access) channels configured to electrically connect the signal lines 110 to the dipole antenna elements 108. The first director element 106*a* is operably coupled to the copper cladding (i.e., ground) on the circuit board 120 with a first sidewall via 112*a*, and the second director element 106*b* is operably coupled to the copper cladding (i.e., ground) on the circuit board 120 with a second sidewall via 112*b*. In an embodiment, the cavity area 104 may be formed with copper cladding along the edges in place of, or in combination with, the first and second sidewall vias 112*a-b*. The cavity area 104 is formed between the first and second sidewall vias 112*a-b*, and may be constructed with a first dielectric material 104*a*. In an example, the dielectric constant of the first dielectric material 104*a* is in a range of 3.3-4.0. In general, the distance between the distal ends of the dipole antenna element 108 and the respective sidewall vias 112*a-b* is about half the wavelength of the operational frequency and the length of the each dipole antenna element is about a quarter of the wavelength of the operational frequency. As an example, and not a limitation, in a millimeter-wave antenna application each dipole antenna element 108 is a microstrip conductor approximately 0.15-0.5 millimeters in width (i.e., +/−10%), and an end-to-end length of approximately 1.55 millimeters (i.e., +/−10%). The distance between the first and second sidewall vias 112*a-b* is approximately 4.55 mm (i.e., +/−10%). Each of the first and second director elements 106*a-b* may be microstrip conductors approximately 0.15-0.5 millimeters in width (i.e., +/−10%), and may extend in towards the dipole antenna element 108 approximately 0.45 mm (i.e., +/−10%) from the respective sidewall via 112*a-b*. The first area 102*a* and the second area 102*b* form a ground plane, and may be an arbitrary size according to some embodiments. The areas 102*a-b* typically include one or more layers of conductors (e.g., Cu, Ag, Au) on the surface of the areas 102*a-b* that extend outward from the sidewalls of the cavity area 104. The dimensions for the millimeter-wave antenna are examples only. Other dimensions may be used based on a desired operational frequency.

Figure 5:
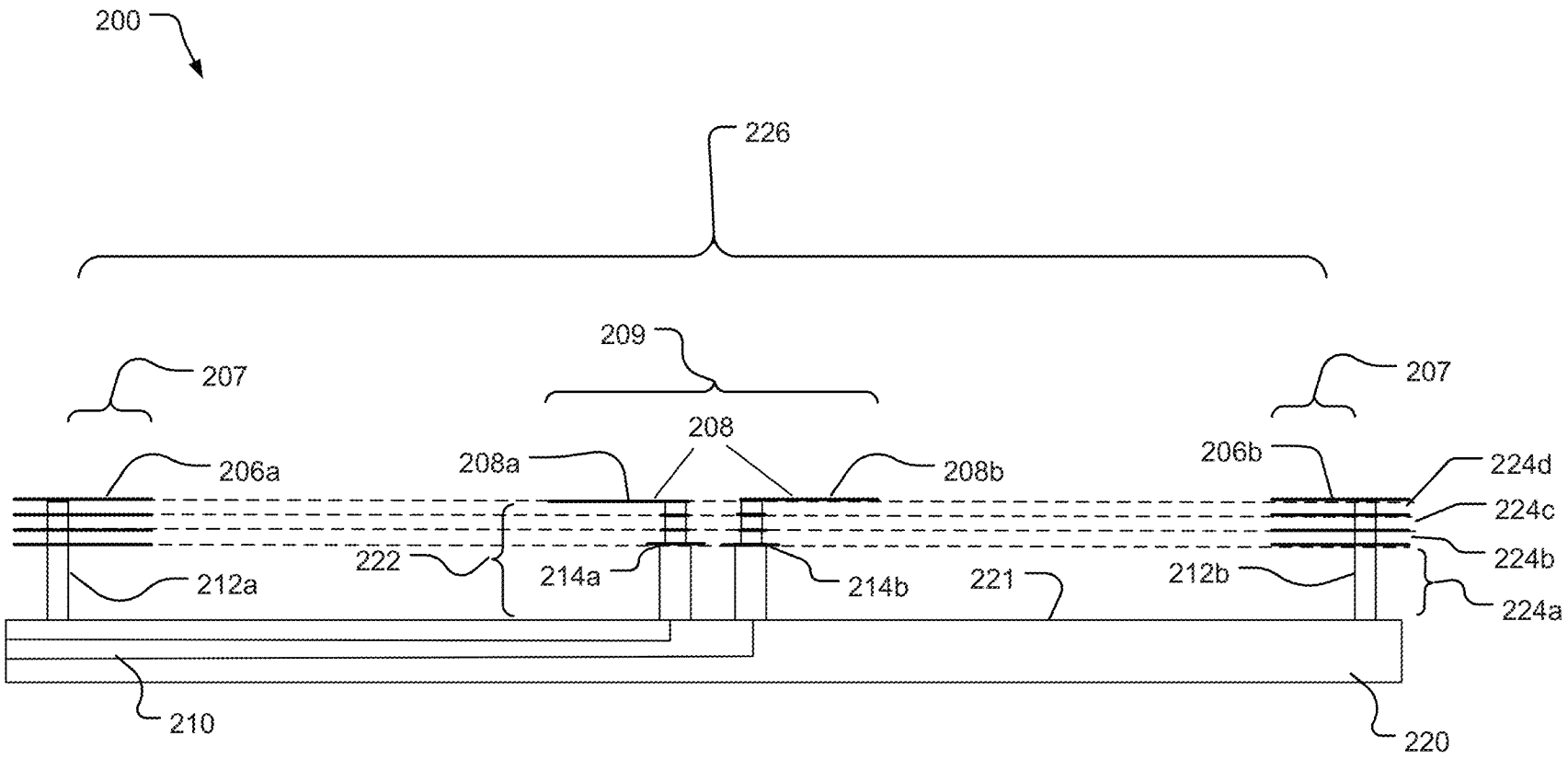
FIG. 5 is a side view of an example layer diagram of a wide-beam dipole antenna.

Referring to FIG. 5, with further reference to FIGS. 3 and 4, a side view of an example layer diagram for a wide-beam dipole antenna 200 is shown. The wide-beam dipole antenna 200 and corresponding dimensions are an example of a millimeter-wave application. The wide-beam dipole antenna 200, however, is not so limited as the dimensions may be varied based on the desired operational frequency and/or circuit board manufacturing techniques. The wide-beam dipole antenna 200 includes a substrate 220 and a conductive cladding 221 (e.g., Cu, Ag) configured as a ground plane. The substrate 220 may comprise a printed circuit board including (e.g., microstrip) signal lines 210 configured to transfer electrical signals to and from a dipole antenna 208. In an example, the substrate 220 is a planar substrate with a top surface and a bottom surface, and one or more signal lines 210 are disposed between the top surface and the bottom surface of the substrate 220. The dipole antenna 208 may include a first dipole element 208*a* and a second dipole element 208*b*. In an example, the dipole antenna 208 spans a distance 209 of approximately of 1.5 mm. A first set of signal vias and via pads 214*a* are configured to electrically couple the first dipole element 208*a* with a signal line 210, and a second set of signal vias and via pads 214*b* are configured to electrically couple the second dipole element 208*b* to another signal line 210. In other examples, one of the dipole elements 208*a-b* may be coupled to the cladding 221 or a BALUN may be used to convert a single line feed to a differential line. In an example manufacturing process, the wide-beam dipole antenna 200 may be constructed by forming successive layers on the substrate 220. In an example, the layers may be manufactured with printed circuit board materials with a dielectric constant in the range of 3.3-4.0. A first layer 224*a* comprising a dielectric material may be formed over the substrate 220. The first layer may include the signal vias and via pads 214*a-b*, and a first sidewall via 212*a* and a second sidewall via 212*b*. In an example, the first and second sidewall vias 212*a-b* may include, or be replaced by, a conductive cladding (e.g., copper) running the length of the cavity. The respective sidewall vias 212*a-b* electrically connect a first director element 206*a* and a second director element 206*b* to the ground plane. The director elements 206*a-b* may include one or more microstrip conductors disposed on top of the dielectric layers 224*a-d*. In a millimeter wave example, the first layer 224*a* has a thickness of approximately 196 microns. A subsequent second layer 224*b*, third layer 224*c* and a fourth layer 224*d* may be formed over the first layer 224*a*. Each of the subsequent layers 224*b-d* includes the director elements 206*a-b* and vias/via pads 214*a-b* structures depicted in FIG. 5. The dipole elements 208*a-b* are disposed on top of the fourth layer 224*d* and electrically coupled to the signal lines 210 through the respective via and via pads 214*a-b*. The director elements 206*a-b* are electrically coupled to the conductive cladding 221 on the substrate 220 through the respective sidewall vias 212*a-b*. Continuing the millimeter wave example, the thickness of each of the second, third and fourth layers 224*b-d* is approximately 68 microns. This thickness may vary based on the limitations of PCB manufacturing technology. A resulting dielectric gap 222 is approximately a quarter wavelength with respect to the dielectric constant of the layer material (e.g., 400 microns). The width of the cavity area 226 (i.e., the distance between the sidewall vias 212*a-b*) is approximately 4.55 millimeters. In an example, a distance between the first sidewall via 212*a* and the second sidewall via 212*b* is approximately one and a quarter wavelengths of an operational frequency of the antenna system. Each of the director elements 206*a-b* extends inwards towards the dipole antenna 208 for a distance 207 of approximately 0.45 mm from the respective sidewall vias 212*a-b*. The length the director elements 206*a-b* extends in from the sidewalls vias 212*a-b* may be varied to adjust the radiation pattern. For example, the length may be between a quarter and an eighth of the wavelength of the operational frequency. The outward side of the director elements 206*a-b* (i.e., outward of the sidewall vias 212*a-b* with respect to the dipole antenna 208) may extend an arbitrary distance away from the cavity to form a ground plane around the cavity area 226. The manufacturing process and dimensions are examples only and not a limitation as other manufacturing processes and dimensions may be used to form the dipole antenna 208, director elements 206*a-b*, and cavity area 226.

Figure 6:
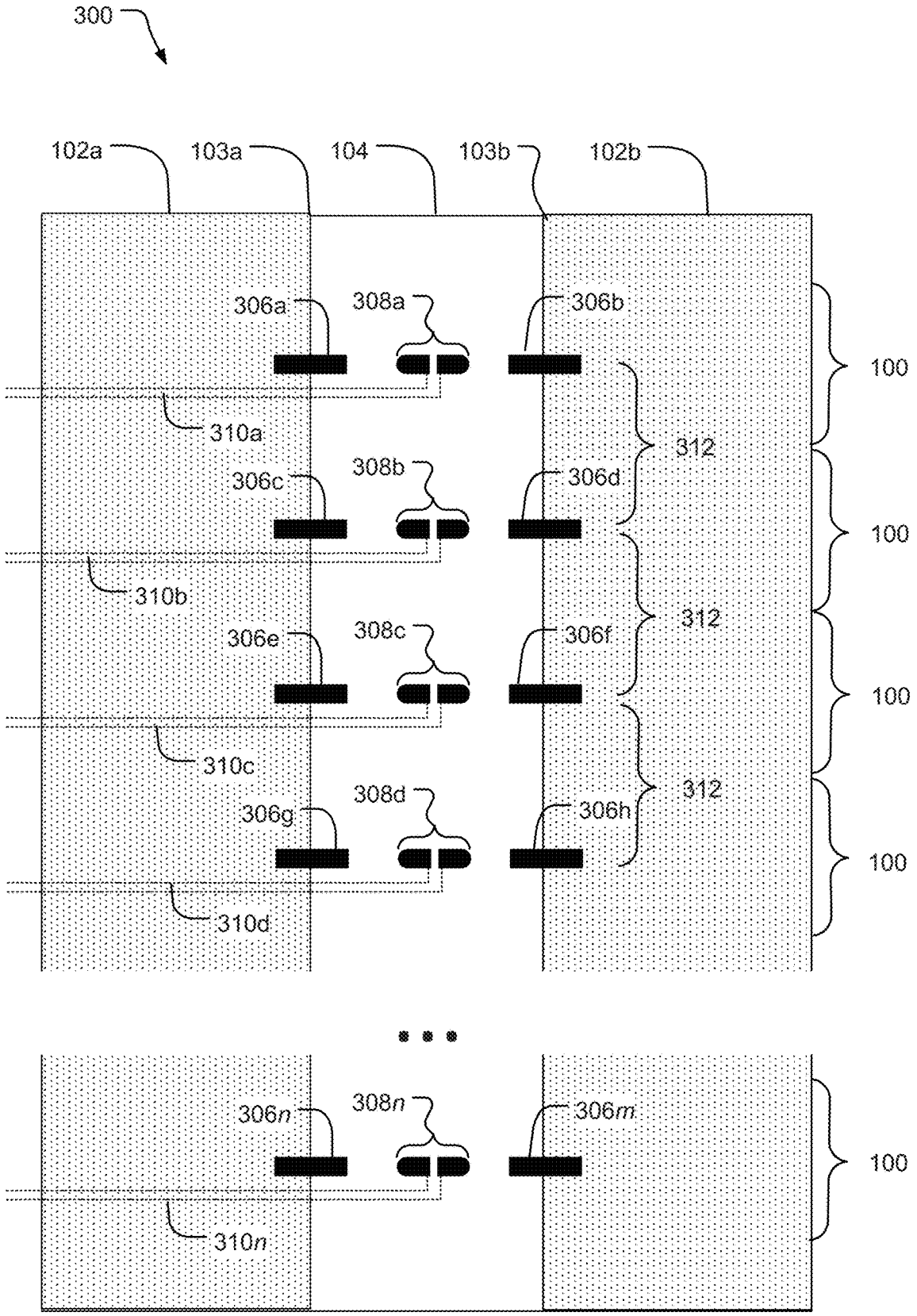
FIG. 6 is a top view of an example antenna array including a plurality of wide-beam dipole antenna cells.

Referring to FIG. 6, with further reference to FIGS. 2-5, an example antenna array 300 including a plurality of wide-beam dipole antenna cells 100 is shown. Each of the wide-beam dipole antenna cells 100 includes a first director element (e.g., 306*a*), a second director element (e.g., 306*b*), a dipole antenna element (e.g., 308*a*), and signal lines (e.g., 310*a*) as described in FIGS. 3-5. The wide-beam dipole antenna cells 100 are spaced linearly (i.e., equally) at a first interval 312 based on the operational frequency and beam performance requirements. In an example, the first interval is approximately between a quarter wavelength and half wavelength. For example, in a millimeter-wave application operating at 79 GHz the first interval may be approximately 1.9 mm, and the antenna array 300 may include 30-70 wide-beam dipole antenna cells 100. A typical antenna array 300 may include 32 antenna cells 100, and in general the more cells in an array will enable narrower beam widths. In an example, the dipole antenna elements 308*a-n* are formed along the centerline of the cavity area 104 for the length of the antenna array 300. In other antenna configurations, the antenna elements 308*a-n* may be closer to one of the sidewalls 103*a-b*. Off-center dipole elements may also be used. A first edge of the cavity area 104 may be a first sidewall 103*a*, and a second edge of the cavity area 104 may be a second sidewall 103*b*. The first area 102*a* covers the area extending from the first sidewall 103*a* such as the boundary line created by the column of first sidewall vias (i.e., under the first director elements 306*a*, 306*c*, 306*e*, 306*g*, 306*n*) and extending outward away from the column of dipole antenna elements 308*a-n*. The second area 102 covers the area extending from the second sidewall 103*b* such as a boundary line created by the column of second sidewall vias (i.e., under the second director elements 306*b*, 306*d*, 306*f*, 306*h*, 306*m*) outward away from the column of dipole antenna elements 308*a-n*. The first sidewall vias and the second sidewall vias form approximately parallel columns as depicted in FIG. 6. The first area 102*a* and the second area 102*b* include a conductive surface covering the length of the array and extending an arbitrary distance outward from the respective sidewalls of the cavity area 104. The first director elements 306*a*, 306*c*, 306*e*, 306*g*, 306*n* are formed along the first sidewall of the cavity area 104 and are electrically coupled to the conductive surface of the first area 102*a*. The second director elements 306*b*, 306*d*, 306*f*, 306*h*, 306*m* are formed along the second sidewall of the cavity area 104 and are electrically coupled to the conductive surface of the second area 102*b*. In an example, the first and second sidewalls 103*a-b* are copper clad and are electrically coupled to the respective directors 306*a-m* and the conductive surfaces of the respective first and second areas 102*a-b*. In an example, the dipole antenna elements 308*a-n* and the first and second director elements 306*a-m* are GCPW (Grounded Co-Planar Waveguide) lines deposited on the dielectric layers as depicted in FIG. 5, but other configurations of antenna and director elements may be used. Various manufacturing techniques may be used to form the antenna array 300. For example, the directors 306*a-m* may span across the metallic layers in the respective first and second areas 102*a-b*, and the length of the directors 306*a-m* may vary based on the distance between the metallic conductors in the first and second sidewalls 103*a-b*. The antenna array 300 is an example of an antenna 52 and the signal lines 310*a-n* are operably coupled to the front-end circuitry 54. The signal lines 310*a-n* are microstrip lines, but other signal line configurations may be used.

Figure 7:
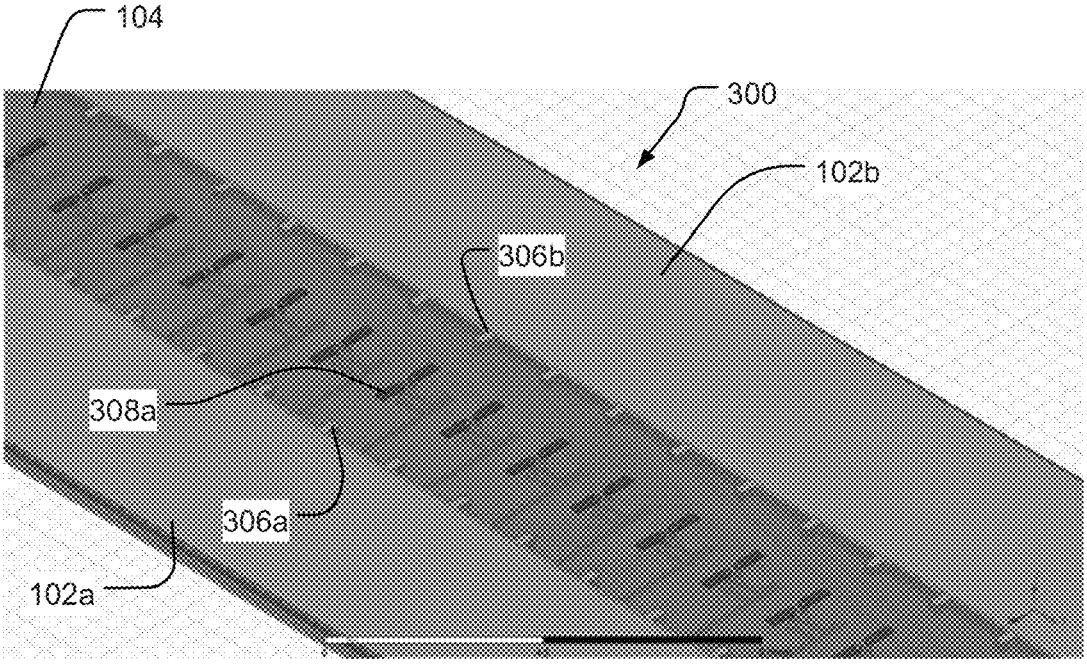
FIG. 7 is a perspective view of the example antenna array shown in FIG. 6.
Figure 8:
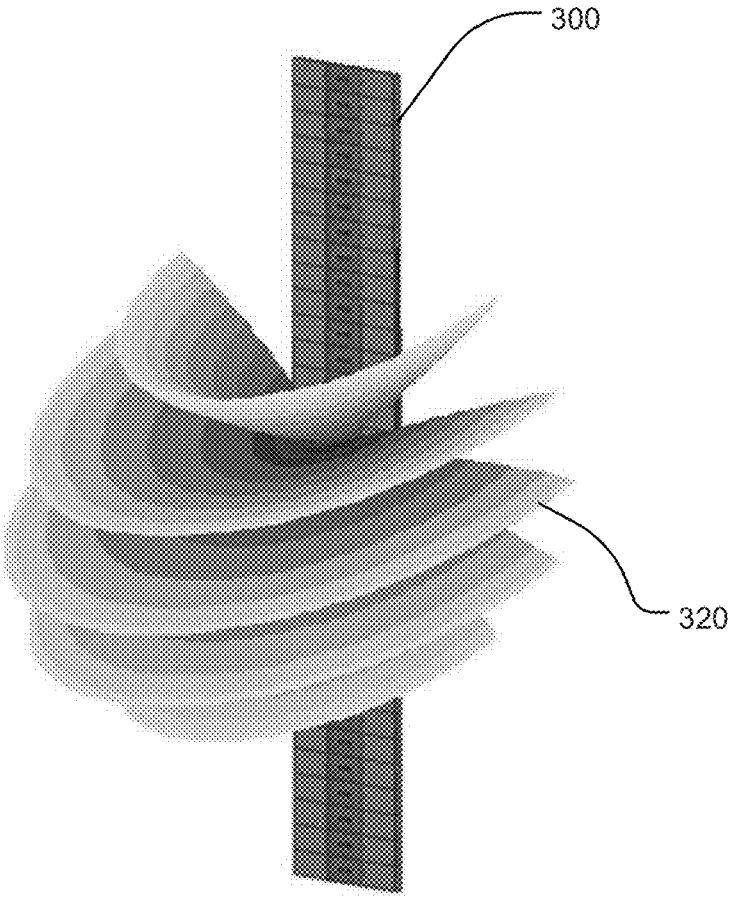
FIG. 8 is a beam diagram for the example antenna array shown in FIG. 7.

Referring to FIG. 7, with further reference to FIG. 6, a perspective view of the antenna array 300 is shown. The antenna array 300 includes a plurality of dipole antenna elements and corresponding director elements disposed in the cavity area 104. For example, the dipole antenna element 308*a* is disposed in the cavity area 104. The cavity area 104 is disposed between the first area 102*a* and the second area 102*b*, which may extend an arbitrary distance away from the cavity area 104. The first director element 306*a* extends inward from the first area 102*a* towards the dipole antenna element 308*a*, and the second director element 306*b* extends inward from the second area 102*b* towards the dipole antenna element 308*a*. In operation, the antenna array 300 may produce a beam array 320 as depicted in FIG. 8. The controller 58 may be configured to scan each of the wide-beam dipole antenna cells 100 to enable elevation scanning (i.e., along the length of the antenna array 300). The configuration of the wide-beam dipole antenna cells 100 enables a beam-width of more than 90 degrees in the E-plane. This is a significant improvement over prior antenna configurations, which typically have beam widths in the range of 30-60 degrees. In an automotive radar example, a scanning transmitting antenna may scan from left to right in a range of +/−45 degrees. The antenna array 300 may be used as a receiving antenna capable of accommodating the same scan range simultaneously. In other examples, the antenna array 300 may be used as a transmitting antenna.

Figure 9:
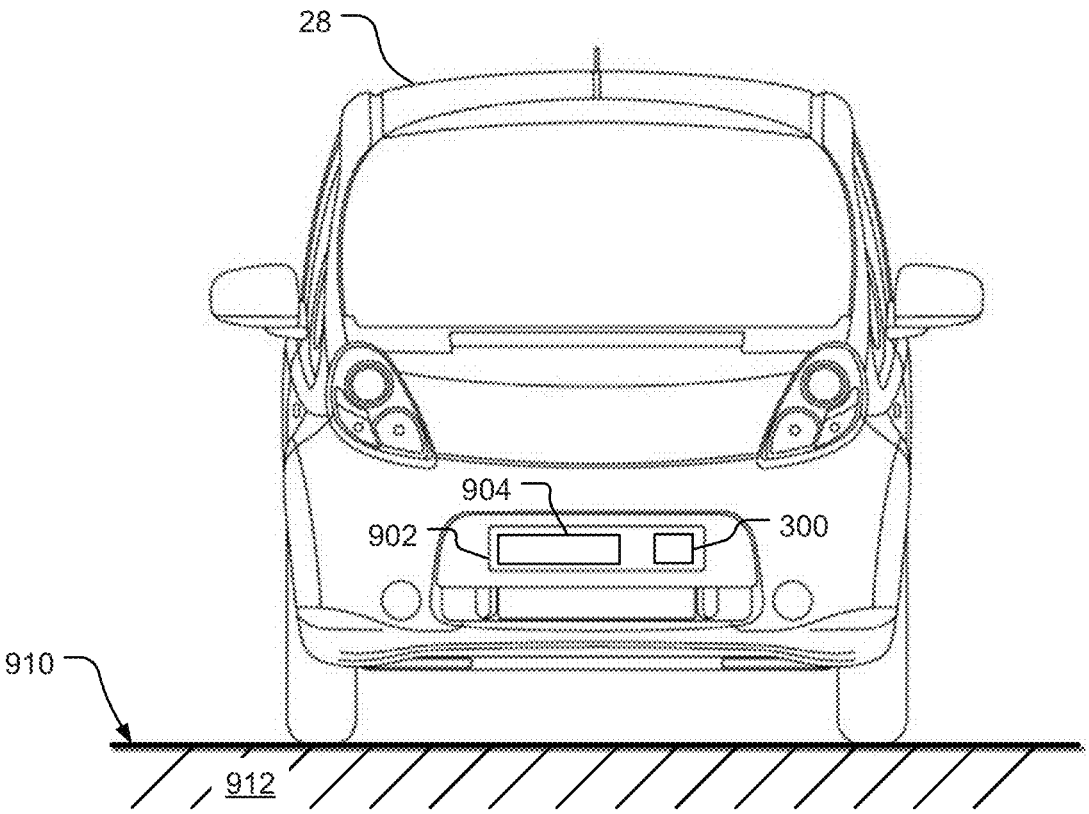
FIG. 9 is a front view of an example use of an antenna system as part of an autonomous vehicle-driving system.
Figure 10:
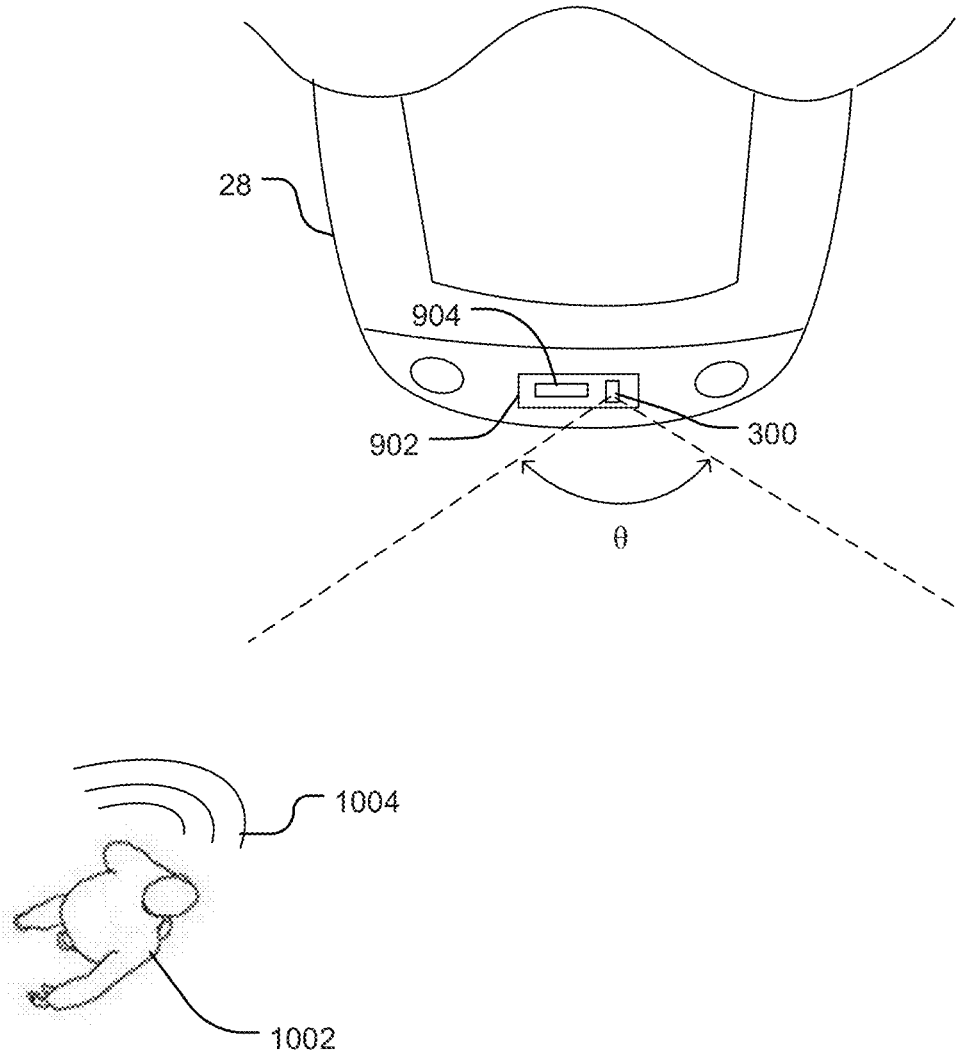
FIG. 10 is a simplified top view of the antenna system in a vehicle shown in FIG. 9.

Referring to FIGS. 9 and 10, with further reference to FIGS. 1-8, an example application for the antenna array 300 is in the vehicle 28 shown in FIG. 1 as part of an object-detection sub-system that is part of an autonomous-driving system. As shown in FIG. 9, the antenna array 300 may be disposed at a front end of the vehicle 28, here in a grill area of the vehicle 28. Alternatively, the antenna array 300 may be located elsewhere on/in the vehicle 28, e.g., at a rear of the vehicle 28, in a bumper of the vehicle 28, etc. An aperture 902 may be provided by the vehicle 28 in a field of view of the antenna array 300 to help avoid interference by the vehicle 28 with signals transmitted by or received by the antenna array 300. The installation of the antenna array 300 may create a ground plane of an arbitrary size. Thus, the configuration of the dipole antenna elements, cavity and director sizes allow for some decoupling of the antenna performance from the size of the ground plane after installation. For this application, a transmit antenna 904 may transmit a radio signal in an area forward of the vehicle to detect objects such as other vehicles, pedestrians, or other obstacles as part of a collision avoidance system. In an example, the transmit antenna 904 may transmit forward at an elevation of about 25°. The transmit antenna 904 may be tilted, e.g., about 7.5° away from a surface 910 of the earth 912 (i.e., the ground) so that the beam-width is directed from about 5° toward the earth to about 20° away from the earth. This would help with detection of obstacles at ground level while helping to avoid detection of obstacles located skyward relative to the vehicle 28. The transmit antenna 904 may be used for transmitting signals and the antenna array 300 may be used for receiving reflections of the signals transmitted by the transmit antenna 904. As depicted in FIG. 10, radio signals are transmitted from the transmit antenna 904 forwards towards a pedestrian 1002. A reflected radio signal 1004 is reflected back towards the vehicle 28 and may be detected by the antenna array 300 configured as a receive array. The antenna array 300 provides a beam-width θ of approximately 90°. The wider beam width provided by the antenna array 300 enables broader detection of obstacles in front of the vehicle. The antenna array 300 may be communicatively coupled to the front-end circuitry 54 and configured to provide the reflected signals to the front-end circuitry 54. The signals provided to the front-end circuitry 54 by the antenna array 300 are transduced signals of the wireless reflected signals, but are referred to as the reflected signals for simplicity. In operation, the antenna array 300 may be configured to sweep in a vertical direction corresponding to the beam width of the transmit antenna 904. In an example, the transmit antenna 904 may be configured to scan laterally (e.g., left to right, right to left) across the plane of the vehicle grill area. The wide-beam features of the antenna array 300 enable the simultaneous detection of signals across this lateral scan area.

Figure 12:
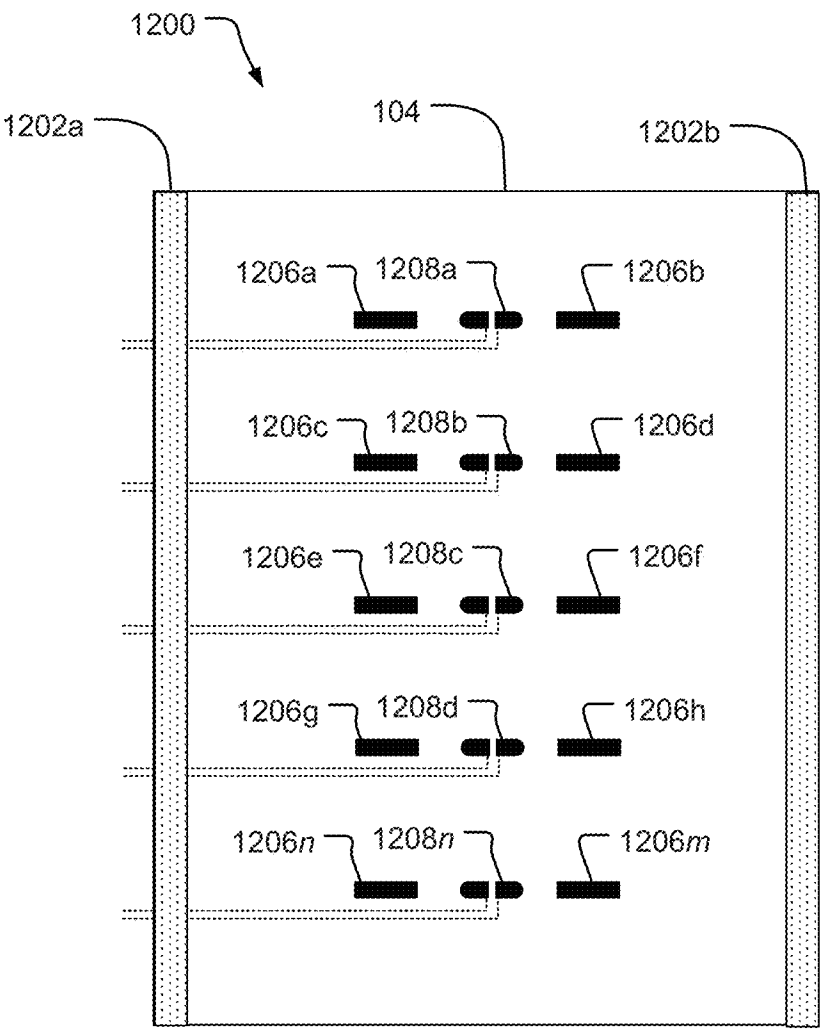
FIG. 12 is a top view of an example dipole antenna with directors.
Figure 11:
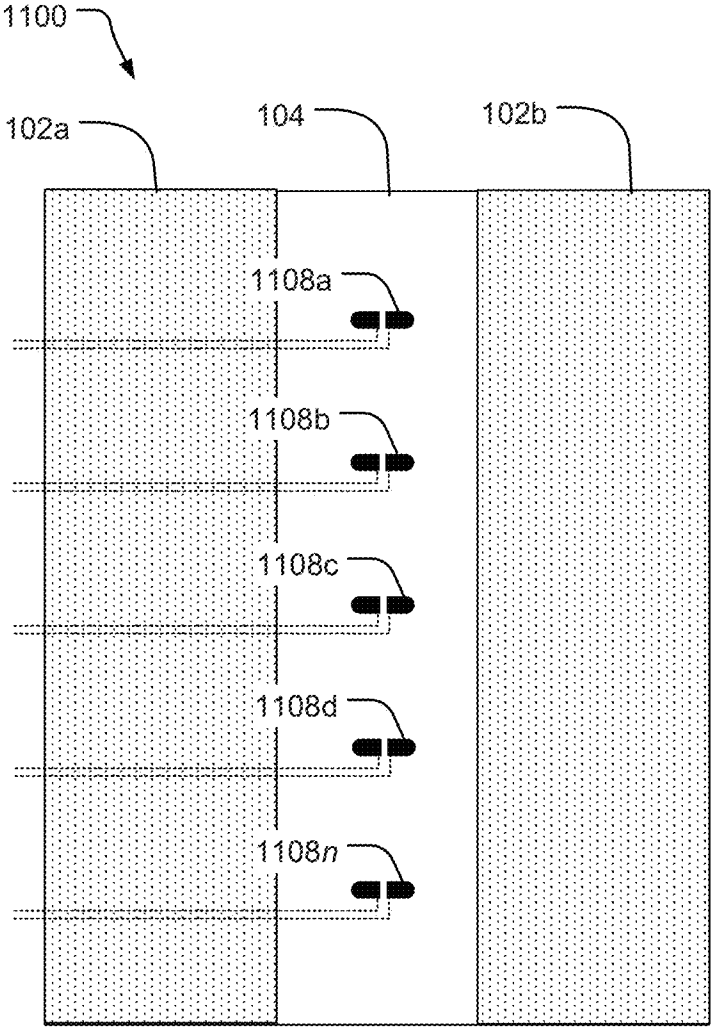
FIG. 11 is a top view of an example of a cavity backed antenna.
Figure 13:
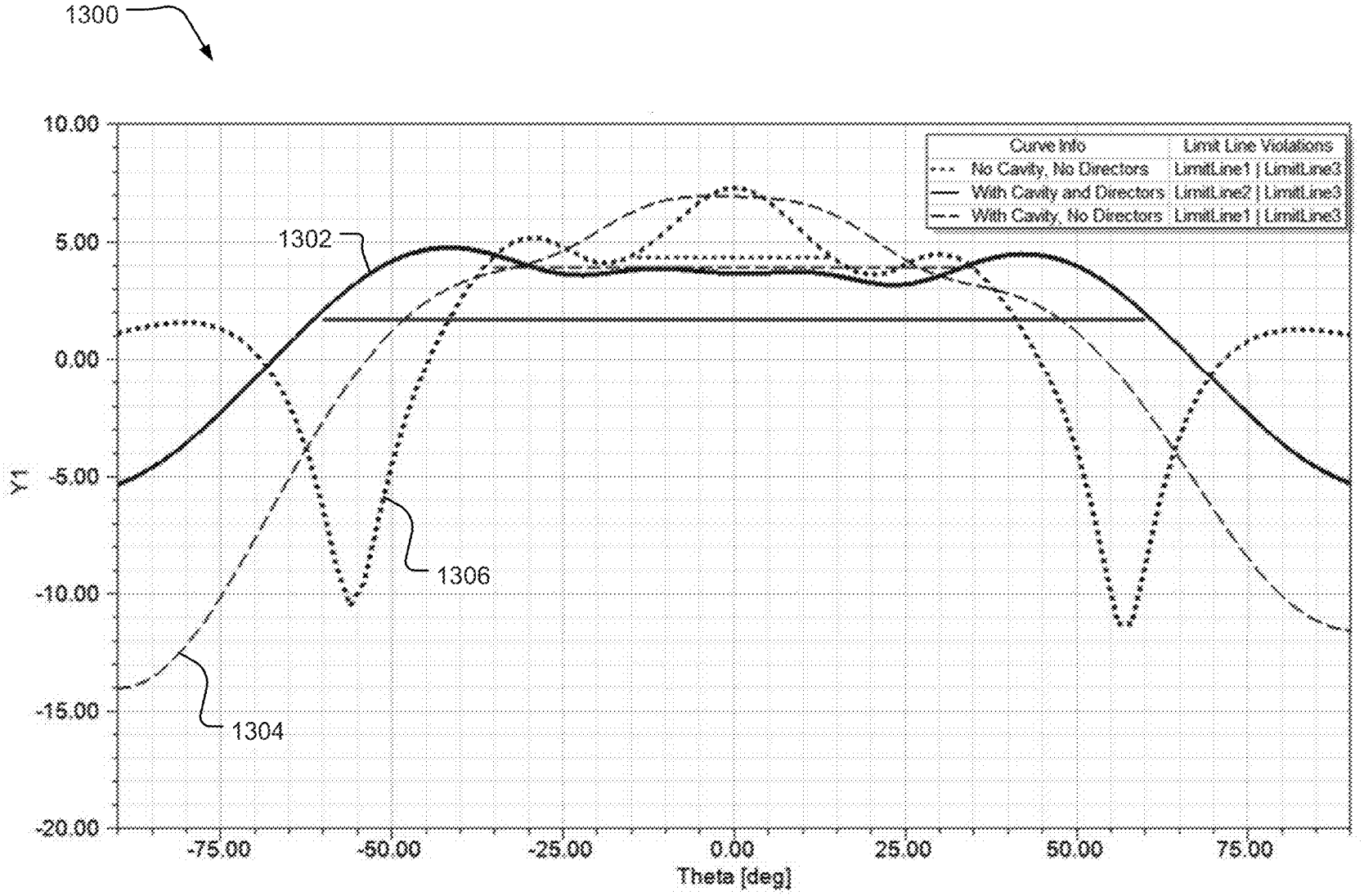
FIG. 13 are plots of beam widths in the E-plane of simulated examples of antenna arrays similar to subarrays shown in FIGS. 3, 11 and 12.

Referring to FIGS. 11 and 12, examples of alternative embodiments of a wide-beam dipole antenna array are shown. In FIG. 11, an example of a cavity backed antenna array 1100 includes a cavity area 104, a first area 102*a*, a second area 102*b* and a plurality of dipole antenna elements 1108*a-n* as previously discussed. The cavity backed antenna array 1100 does not include director elements along the cavity walls. In FIG. 12, an example of a dipole antenna array with directors 1200 includes a cavity area 104, with a first edge area 1202*a* and a second edge area 1202*b*. The cavity area 104 includes a plurality of dipole antenna elements 1208*a-n* as previously discussed, but the director elements 1206*a-m* are disposed in the same relative location to the respective dipole antenna element s1208*a-n* but without the sidewall vias described in FIG. 5. For example, the director elements 206*a-b* may be micro strips of approximately 0.9 mm in length deposited on each of the layers 224*a-d* as depicted in FIG. 5 without the corresponding vias 212*a-b*. While the alternative embodiments provided in FIGS. 11 and 12 provide beam-width improvements over prior art antenna systems, the expected beam-width performance may be less than that of the antenna array 300 depicted in FIG. 6. For example, referring to FIG. 13, simulations were performed on different antenna array designs. A first plot line 1302 corresponds with the beam-width performance of the antenna array 300 (i.e., with a cavity and directors), a second plot line 1304 corresponds to the performance of the array 1100 (i.e., with a cavity and no directors), and a third plot line 1306 corresponds to an array of dipole antennas with no cavity and no directors. As indicated, the antenna array 300 provides a marked beam-width performance improvement as compared to the other antenna configurations.

Other examples and implementations are within the scope and spirit of the disclosure and appended claims. For example, due to the nature of software and computers, functions described above can be implemented using software executed by a processor, hardware, firmware, hardwiring, or a combination of any of these. Features implementing functions may also be physically located at various positions, including being distributed such that portions of functions are implemented at different physical locations.

As used herein, an indication that a device is configured to perform a stated function means that the device contains appropriate equipment (e.g., circuitry, mechanical device(s), hardware, software (e.g., processor-readable instructions), firmware, etc.) to perform the stated function. That is, the device contains equipment that is capable of performing the stated function, e.g., with the device itself having been designed and made to perform the function, or having been manufactured such that the device includes equipment that was designed and made to perform the function. An indication that processor-readable instructions are configured to cause a processor to perform functions means that the processor-readable instructions contain instructions that when executed by a processor (after compiling as appropriate) will result in the functions being performed.

Also, as used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

As used herein, unless otherwise stated, a statement that a function or operation is "based on" an item or condition means that the function or operation is based on the stated item or condition and may be based on one or more items and/or conditions in addition to the stated item or condition.

Further, an indication that information is sent or transmitted, or a statement of sending or transmitting information, "to" an entity does not require completion of the communication. Such indications or statements include situations where the information is conveyed from a sending entity but does not reach an intended recipient of the information. The intended recipient, even if not actually receiving the information, may still be referred to as a receiving entity, e.g., a receiving execution environment. Further, an entity that is configured to send or transmit information "to" an intended recipient is not required to be configured to complete the delivery of the information to the intended recipient. For example, the entity may provide the information, with an indication of the intended recipient, to another entity that is capable of forwarding the information along with an indication of the intended recipient.

A wireless communication system is one in which communications are conveyed wirelessly, i.e., by electromagnetic and/or acoustic waves propagating through atmospheric space rather than through a wire or other physical connection. A wireless communication network may not have all communications transmitted wirelessly, but is configured to have at least some communications transmitted wirelessly. Further, a wireless communication device may communicate through one or more wired connections as well as through one or more wireless connections.

Substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure. The term "approximately" as used herein will include values in a range of plus or minus 10% of the stated approximate value.

Components, functional or otherwise, shown in the figures and/or discussed herein as being connected or communicating with each other are communicatively coupled. That is, they may be directly or indirectly connected to enable communication between them.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

The invention claimed is:

1. An antenna system, comprising:

at least one wide-beam dipole antenna cell, comprising:

a substrate with a top surface and a bottom surface;

one or more signal lines disposed between the top surface and the bottom surface of the substrate;

a conductive cladding disposed on the top surface of the substrate;

a dielectric layer disposed on the conductive cladding;

a first sidewall via extending orthogonal to the top surface of the substrate through the dielectric layer and electrically coupled to the conductive cladding;

a second sidewall via extending orthogonal to the top surface of the substrate through the dielectric layer and electrically coupled to the conductive cladding;

a dipole antenna element disposed on the dielectric layer between the first sidewall via and the second sidewall via, including a first dipole antenna element directed towards the first sidewall via and a second dipole antenna element directed towards the second sidewall via;

at least one signal via configured to electrically couple the dipole antenna element to the one or more signal lines;

a first director element disposed on the dielectric layer and extending toward the dipole antenna element, the first director element being electrically coupled to the first sidewall via; and a second director element disposed on the dielectric layer and extending toward the dipole antenna element, the second director element being electrically coupled to the second sidewall via.

2. The antenna system of claim 1 wherein the at least one wide-beam dipole antenna cell further comprises a first conductive area extending from the first sidewall via in a direction away from the dipole antenna element, and a second conductive area extending from the second sidewall via in a direction away from the dipole antenna element, the first conductive area and the second conductive area comprising a conductive cladding disposed on the dielectric layer.

3. The antenna system of claim 1 wherein the first director element, the second director element and the dipole antenna element are microstrip conductors.

4. The antenna system of claim 1 wherein a distance between the first sidewall via and the second sidewall via is approximately one and a quarter wavelengths of an operational frequency of the antenna system.

5. The antenna system of claim 1 wherein a length of the first dipole antenna element or the second dipole antenna element is approximately a quarter wavelength of an operational frequency of the antenna system.

6. The antenna system of claim 1 wherein the first director element and the second director element each extend in towards the dipole antenna element from the first sidewall via and the second sidewall via, respectively, for a distance of approximately one-eighth of a wavelength of an operational frequency of the antenna system.

7. The antenna system of claim 1 wherein a distance between the dipole antenna element and the conductive cladding disposed on the top surface of the substrate is approximately a quarter wavelength of an operational frequency of the antenna system with respect to a dielectric constant of the dielectric layer disposed between the dipole antenna element and the conductive cladding.

8. The antenna system of claim 1 wherein a length of the dipole antenna element is approximately 1.55 mm, a distance between the first sidewall via and the second sidewall via is approximately 4.55 mm, and a length the first director element and the second director element extending in from the first sidewall via and the second sidewall via, respectively, is 0.45 mm.

9. The antenna system of claim 1 wherein a dielectric constant of the dielectric layer is approximately 3.3 to 4.0.

10. The antenna system of claim 1 further comprising a plurality of wide-beam dipole antenna cells disposed in a column wherein a corresponding plurality of first sidewall vias, dipole antenna elements, and second sidewall vias form approximately parallel columns.

11. The antenna system of claim 10 further comprising a first area extending outward from a first boundary line formed by a column of the first sidewall vias in a direction away from a column of the dipole antenna elements, and a second area extending outward from a second boundary line formed by a column of the second sidewall vias in a direction away from the column of the dipole antenna elements, wherein the first area and the second area include a conductive cladding disposed on the dielectric layer.

12. The antenna system of claim 10 wherein a distance between the dipole antenna elements in each of the plurality of wide-beam dipole antenna cells is approximately half a wavelength of an operational frequency of the antenna system.

13. The antenna system of claim 10 comprising 30 to 70 wide-beam dipole antenna cells disposed in a column.

14. An antenna system, comprising:

a substrate with a cavity formed therein, the cavity having a first sidewall and a second sidewall disposed parallel to one another and forming the respective outside edges of the cavity;

a dielectric material disposed in the cavity between the first sidewall and the second sidewall;

a plurality of dipole antennas disposed on the dielectric material and at equal distances from one another along a centerline of the cavity, wherein each of the plurality of dipole antennas includes a first element directed towards the first sidewall and a second element directed towards the second sidewall;

a plurality of first director elements disposed on the dielectric material along the first sidewall, wherein a distance between each of the plurality of first director elements is equal to the distance between each of the plurality of dipole antennas, and at least a portion of each of the plurality of first director elements extends inward towards one of the plurality of dipole antennas; and a plurality of second director elements disposed on the dielectric material along the second sidewall, wherein a distance between each of the plurality of second director elements is equal to the distance between each of the plurality of dipole antennas, and at least a portion of each of the plurality of second director elements extends inward towards one of the plurality of dipole antennas.

15. The antenna system of claim 14 further comprising a conductive layer disposed on the substrate in a first area extending outward from the first sidewall and away from the cavity, and a second area extending outward from the second sidewall and away from the cavity.

16. The antenna system of claim 14 further comprising a plurality of signal lines disposed under the cavity, wherein at least one of the plurality of signal lines is operably coupled to at least one of the plurality of dipole antennas.

17. The antenna system of claim 14 wherein the plurality of dipole antennas, the plurality of first director elements, and the plurality of second director elements are microstrip conductors.

18. The antenna system of claim 14 wherein a width of the cavity measured from the first sidewall to the second sidewall is approximately 1.25 times a wavelength of an operational frequency of the antenna system.

19. The antenna system of claim 14 wherein a length of each of the plurality of dipole antennas is approximately 0.5 times a wavelength of an operational frequency of the antenna system.

20. The antenna system of claim 14 wherein each of the plurality of first director elements and each of the plurality of second director elements extend in from the first sidewall and the second sidewall, respectively, for a distance of approximately 0.125 times a wavelength of an operational frequency of the antenna system.

21. The antenna system of claim 14 wherein a distance between a distal end of each of the first elements in the plurality of dipole antennas and the first sidewall and a distal end of each of the second elements in the plurality of dipole antennas and the second sidewall is approximately 0.5 times a wavelength of an operational frequency of the antenna system.

22. The antenna system of claim 14 wherein a depth of the cavity and a thickness of the dielectric material is approximately 0.25 times a wavelength of an operational frequency of the antenna system.

23. The antenna system of claim 14 wherein a dielectric constant of the dielectric material is approximately 3.3 to 4.0.

24. The antenna system of claim 14 wherein the plurality of dipole antennas includes 30-70 dipole antennas.

25. The antenna system of claim 14 wherein a distance between each of the plurality of dipole antennas equals approximately 0.5 times a wavelength of an operational frequency of the antenna system.

26. The antenna system of claim 14 wherein a length of each of the plurality of dipole antennas is approximately 1.55 mm, a distance between the first sidewall via and the second sidewall via is approximately 4.55 mm, and a length of each of the plurality of first director elements and each of the plurality of second director elements extending in from the first sidewall and the second sidewall, respectively, is 0.45 mm.

* * * * *